US007273427B2

(12) United States Patent
Inoue et al.

(10) Patent No.: US 7,273,427 B2
(45) **Date of Patent: *Sep. 25, 2007**

(54) METHOD AND SYSTEM FOR SELECTING A GOLF CLUB

(75) Inventors: Taku Inoue, Tokyo (JP); Hiroshi Teraoka, Tokyo (JP); Mitsuhiro Kuromi, Tokyo (JP); Minoru Inagaki, Tokyo (JP); Shu Katayama, Saitama (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 383 days.

This patent is subject to a terminal disclaimer.

(21) Appl. No.: 10/231,456

(22) Filed: Aug. 30, 2002

(65) Prior Publication Data

US 2004/0043839 A1 Mar. 4, 2004

(51) Int. Cl.
*A63B 69/36* (2006.01)

(52) U.S. Cl. ..... 473/407

(58) Field of Classification Search ..... None
See application file for complete search history.

(56) References Cited

U.S. PATENT DOCUMENTS

| | | | | | |
|---|---|---|---|---|---|
| 3,717,857 | A | * | 2/1973 | Evans | 340/870.13 |
| 4,059,270 | A | * | 11/1977 | Sayers | 473/409 |
| 4,063,259 | A | * | 12/1977 | Lynch et al. | 396/335 |
| 4,375,887 | A | * | 3/1983 | Lynch et al. | 473/409 |
| 5,111,410 | A | * | 5/1992 | Nakayama et al. | 434/258 |
| 5,246,232 | A | | 9/1993 | Eccher et al. | |
| 5,441,256 | A | * | 8/1995 | Hackman | 473/409 |
| 5,471,383 | A | | 11/1995 | Gobush et al. | |
| 5,474,298 | A | * | 12/1995 | Lindsay | 473/222 |
| 5,481,355 | A | | 1/1996 | Iijima et al. | |
| 5,591,091 | A | * | 1/1997 | Hackman | 473/289 |
| 5,772,522 | A | * | 6/1998 | Nesbit et al. | 473/222 |
| 5,864,960 | A | * | 2/1999 | DeNicolo et al. | 33/508 |
| 5,911,636 | A | * | 6/1999 | Schmoll | 473/266 |
| 6,014,887 | A | * | 1/2000 | Naruo et al. | 73/12.04 |
| 6,042,483 | A | * | 3/2000 | Katayama | 473/199 |
| 6,073,086 | A | | 6/2000 | Marinelli | |

(Continued)

FOREIGN PATENT DOCUMENTS

JP 63-257583 A 10/1988

(Continued)

OTHER PUBLICATIONS

Office Action, May 13, 2004 (Japanese Patent Application No. 2000-83633).

(Continued)

*Primary Examiner*—Robert E. Pezzuto
*Assistant Examiner*—Tramar Harper
(74) *Attorney, Agent, or Firm*—Sughrue Mion Pllc.

(57) ABSTRACT

A method for selecting a golf club suitable for a golfer includes the steps of (a) obtaining at least one of head speed and hit-ball data (initial velocity, launch angle, backspin, side spin, and travel distance) when a golfer hits a golf ball with a golf club; (b) obtaining ideal hit-ball data of the golfer on the basis of the at least one of head speed and hit-ball data obtained in step (a); and (c) selecting a golf club suitable for the golfer on the basis of the ideal hit-ball data obtained in step (b).

16 Claims, 3 Drawing Sheets

U.S. PATENT DOCUMENTS

| | | | | |
|---|---|---|---|---|
| 6,083,123 | A * | 7/2000 | Wood | 473/409 |
| 6,192,323 | B1 * | 2/2001 | Boehm | 702/182 |
| 6,368,230 | B1 * | 4/2002 | Helmstetter et al. | 473/244 |
| 6,371,862 | B1 | 4/2002 | Reda | |
| 6,385,559 | B2 | 5/2002 | Boehm | |
| 6,458,035 | B1 | 10/2002 | Katayama | |
| 6,488,591 | B1 * | 12/2002 | Gobush et al. | 473/199 |
| 6,533,674 | B1 | 3/2003 | Gobush | |
| 6,565,448 | B2 | 5/2003 | Cameron et al. | |
| 6,569,040 | B2 * | 5/2003 | Bradstock | 473/407 |
| 6,579,190 | B2 | 6/2003 | Yamamoto | |
| 6,602,144 | B2 | 8/2003 | Manwaring et al. | |
| 6,611,792 | B2 * | 8/2003 | Boehm | 702/182 |
| 6,669,571 | B1 | 12/2003 | Cameron et al. | |
| 6,719,648 | B1 * | 4/2004 | Smith | 473/409 |
| 6,742,385 | B2 | 6/2004 | Katayama | 73/65.03 |
| 6,764,412 | B2 | 7/2004 | Gobush et al. | |
| 6,834,129 | B2 | 12/2004 | Asakura | |
| 6,887,162 | B2 * | 5/2005 | Lindsay | 473/151 |
| 2002/0072429 | A1 * | 6/2002 | Rankin et al. | 473/287 |
| 2002/0119828 | A1 * | 8/2002 | Toulon et al. | 473/287 |
| 2003/0008791 | A1 * | 1/2003 | Chiang | 510/130 |
| 2003/0040380 | A1 * | 2/2003 | Wright et al. | 473/409 |
| 2004/0127303 | A1 | 7/2004 | Teraoka | |

FOREIGN PATENT DOCUMENTS

| | | |
|---|---|---|
| JP | 5-55158 A | 5/1993 |
| JP | 6-86845 | 3/1994 |
| JP | 7-000582 | 1/1995 |
| JP | 3-037203 | 2/1997 |
| JP | 10-186474 | 7/1998 |
| JP | 2000-19186 A | 1/2000 |
| JP | 2001-269425 A | 10/2001 |

OTHER PUBLICATIONS

Decision of Rejection, Feb. 2, 2005 (Japanese Patent Application No. 2000-83633).

* cited by examiner

METHOD AND SYSTEM FOR SELECTING A GOLF CLUB

BACKGROUND OF THE INVENTION

1. Field of the Invention

The present invention relates to a method and system for selecting a golf club suitable for a golfer.

2. Description of the Related Art

In order to select a golf club suitable for a golfer, there has conventionally been used a method in which the golfer is requested to hit golf balls with various golf clubs; head speeds of the golf clubs at that time are measured; and a golf club suitable for the golfer is selected on the basis of the head speeds.

However, the aforementioned conventional method is adapted to select a golf club on the basis of a head speed that a golfer can attain (hereinafter referred to as a "head speed of a golfer"), and the types of data used for selection are few. Therefore, in some cases, the conventional method fails to select a golf club suitable for the golfer.

SUMMARY OF THE INVENTION

The present invention has been accomplished in view of the foregoing, and an object of the present invention is to provide a method and system for properly selecting a golf club suitable for a golfer.

To achieve the above object, the present inventors have carried out earnest studies and found that a golf club suitable for a golfer can be properly selected when the selection is performed in consideration of not only a head speed of a golfer but also hit-ball data of the golfer, such as initial velocity, launch angle, backspin, and side spin of a hit ball; specifically, when actual hit data such as a head speed of a golfer is obtained, ideal hit-ball data of the golfer are calculated on the basis of the actual hit data, and a golf club which is suitable for realization of the ideal hit-ball data is selected. Thus, the present inventors have conceived the present invention.

The present invention has been accomplished on the basis of the above-described findings. The present invention provides a method for selecting a golf club suitable for a golfer, comprising the steps of:

(a) obtaining at least one of head speed and hit-ball data when a golfer hits a golf ball with a golf club;

(b) obtaining ideal hit-ball data of the golfer on the basis of the at least one of head speed and hit-ball data obtained in step (a); and (c) selecting a golf club suitable for the golfer on the basis of the ideal hit-ball data obtained in step (b).

Further, the present invention provides a system for selecting a golf club suitable for a golfer, comprising:

actual hit data obtainment means for obtaining at least one of head speed and hit-ball data when a golfer hits a golf ball with a golf club; and ideal data obtainment means for obtaining ideal hit-ball data of the golfer on the basis of the at least one of head speed and hit-ball data obtained by the actual hit data obtainment means, wherein a golf club suitable for the golfer is selected on the basis of the ideal hit-ball data obtained by the ideal data obtainment means.

The method and system for selecting a golf club according to the present invention enables proper selection of a golf club suitable for a golfer.

DESCRIPTION OF THE INVENTION AND PREFERRED EMBODIMENT

Figure 1:
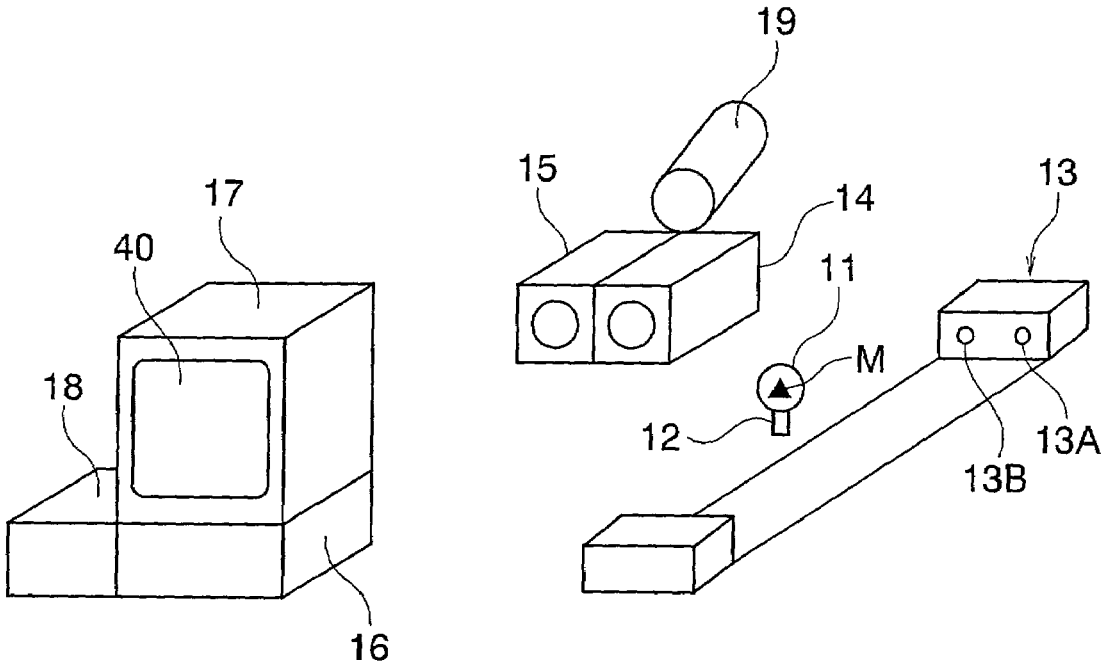
FIG. 1 is a schematic diagram of an embodiment of the system for selecting a golf club according to the present invention.

The present invention will now be described in further detail. In the present invention, first, a golfer is requested to hit a golf ball by use of a golf club, and at least one of head speed and hit-ball data is obtained at that time. The term "hit-ball data" means various numerical data in relation to a golf ball at the time the golfer hits the golf ball. Examples of the hit-ball data include initial velocity, launch angle, backspin, side spin, and travel distance of a hit ball.

In the present invention, at least one of head speed, initial velocity, launch angle, backspin, side spin, and travel distance is selected as the above-described at least one of head speed and hit-ball data; preferably, all these values are obtained. When all values of the above-described items are obtained, numerous data regarding the golfer who has hit balls can be obtained. Notably, as shown in an embodiment to be described later, the above-described head speed, initial velocity, launch angle, backspin, and side spin can be measured by use of a measurement apparatus; and the travel distance can be calculated from the initial velocity, launch angle, backspin, and side spin.

A golf club which the golfer has used for play and which is therefore familiar to the player is preferably used as the golf club to be used by the golfer to hit a golf ball. This enables acquisition of proper head speed and hit-ball data, to thereby enable more proper selection of a golf club suitable for the golfer.

In the present invention, ideal hit-ball data of the golfer are obtained on the basis of the at least one of head speed and hit-ball data, obtained in the above-described manner. At least one of ideal initial velocity, ideal launch angle, ideal backspin, ideal side spin, and ideal travel distance is selected as the ideal hit-ball data; preferably, all these values are obtained. When all values of the above-described items are obtained, many data useful for selection of a club can be obtained. The ideal hit-ball data can be obtained through calculation or can be set in advance. For example, the ideal initial velocity, ideal launch angle, and ideal backspin can be obtained from a head speed at the time the golfer actually hits a golf ball, in accordance with predetermined calculation expression. Further, the ideal side spin may be set to zero. Further, the ideal travel distance can be calculated from the ideal initial velocity, ideal launch angle, ideal backspin, and ideal side spin, in accordance with predetermined calculation expression.

In the present invention, a golf club suitable for the golfer is selected on the basis of the ideal hit-ball data obtained in the above-described manner. That is, one or more types of golf clubs which are suitable for realization of the ideal hit-ball data are selected. This selection may be performed manually by a person or performed automatically by club selection means for selecting a golf club suitable for the golfer on the basis of the ideal hit-ball data.

In the above-described manner, the present invention enables proper selection of a golf club suitable for a golfer. Moreover, head speed and hit-ball data are preferably obtained when the golfer hits a golf ball with the selected golf club. This enables checking of the effect of the selected club. In this case, at least one of initial velocity, launch angle, backspin, side spin, and travel distance is selected as the above-described hit-ball data; preferably, all these values are obtained. When all values of the above-described items are obtained, the effect of the selected golf club can be checked on the basis of numerous data.

In the present invention, data regarding the specifications of a golf club with which the golfer hits a golf ball are preferably obtained separately. Reference to the specification data enables further proper selection of a golf club suitable for the golfer. In this case, the specification data include the total length, balance, total weight, loft angle, face angle, and lie angle of a golf club.

The following are preferred modes of the method and system for selecting a golf club according to the present invention.

Mode 1:

A method for selecting a golf club suitable for a golfer, comprising the steps of:

(a) obtaining at least one of head speed and hit-ball data (preferably, head speed, initial velocity, launch angle, backspin, side spin, and travel distance) when a golfer hits a golf ball with a golf club (preferably a golf club which the golfer has used up to now);

(b) obtaining ideal hit-ball data (preferably, initial velocity, launch angle, backspin, side spin, and travel distance) of the golfer on the basis of the at least one of head speed and hit-ball data (e.g., head speed) obtained in step (a);

(c) selecting a golf club suitable for the golfer on the basis of the ideal hit-ball data obtained in step (b); and (d) obtaining head speed and hit-ball data (preferably, initial velocity, launch angle, backspin, side spin, and travel distance) when the golfer hits a golf ball with the golf club selected in step (c).

Mode 2:

A system for selecting a golf club suitable for a golfer, comprising:

actual hit data obtainment means for obtaining at least one of head speed and hit-ball data (preferably, head speed, initial velocity, launch angle, backspin, side spin, and travel distance) when a golfer hits a golf ball with a golf club (preferably a golf club which the golfer has used up to now); and ideal data obtainment means for obtaining ideal hit-ball data (preferably, initial velocity, launch angle, backspin, side spin, and travel distance) of the golfer on the basis of at least one of head speed and hit-ball data (e.g., head speed) obtained by the actual hit data obtainment means, wherein a golf club suitable for the golfer is selected on the basis of the ideal hit-ball data obtained by the ideal data obtainment means; and head speed and hit-ball data (preferably, initial velocity, launch angle, backspin, side spin, and travel distance) are obtained by the actual hit data obtainment means when the golfer hits a golf ball with the selected golf club.

The system for selecting a golf club suitable for a golfer according to the present invention preferably includes comment producing means for producing a comment for the golfer on the basis of the at least one of the head speed and hit-ball data obtained by the actual hit data obtainment means. The comment enables the golfer to clearly know his or her swing characteristic and the effect of the selected golf club.

The system for selecting a golf club suitable for a golfer according to the present invention preferably includes printing means for printing at least one selected from the head speed and hit-ball data obtained by the actual hit data obtainment means, ideal hit-ball data obtained by the ideal data obtainment means, and the comment produced by the comment producing means. This enables the golfer to easily know his or her swing characteristic and the effect of the selected golf club.

An embodiment of the present invention will now be described with reference to the drawings. FIG. 1 is a schematic diagram showing an embodiment of the system for selecting a golf club according to the present invention. The system includes golf ball setting means 12 for setting a golf ball 11 in place; specifically a tee for placing the golf ball 11 thereon, (hereinafter referred to as tee 12); sensor means 13 for detecting the passing (downswing) of a club head (not shown) for hitting the ball 11; a first camera 14 and a second camera 15; a control unit 16; a monitor 17; and a printer 18. The sensor means 13 is located behind the tee 12 with respect to the travel direction of the hit ball 11. The first camera 14 and the second camera 15 are disposed ahead of the tee 12 with respect to the travel direction of the ball 11 such that they are located a predetermined distance from the tee 12 and are apart from each other and face horizontally. The control unit 16 has trigger means for sending shutter signals for the hit ball 11 to the respective first and second cameras 14 and 15. When a detection signal is received from the sensor means 13, the trigger means sends shutter signals to the first and second cameras 14 and 15 at a proper timing such that an appropriate time lag is provided between the shutter signals sent to the first and second cameras 14 and 15. Reference letter M represents a mark printed on the surface of the ball 11. When measurement is performed by use of the present system, the ball 11 is set on the tee 12 in a state in which the mark M faces the side where the cameras 14 and 15 are present. The first and second cameras 14 and 15 are preferably CCD cameras each having a shutter speed of $1/10{,}000$ to $1/200{,}000$ second.

The sensor means 13 includes a pair of optical sensors, or a first sensor 13A and a second sensor 13B, each composed of a light-emitting element and a light-receiving element. The distance m2 between the tee 12 and the sensor means 13 is preferably approximately 40 mm. The distance m3 between the tee 12 and the first camera 14 and the distance m4 between the first and second cameras 14 and 15 preferably range from 50 to 300 mm and from 100 to 250 mm, respectively. The positional height of the first and second cameras 14 and 15 with respect to the golf ball 11 (placed on the tee 12) must be determined in consideration of the trajectory of the hit ball 11. For a certain site of measurement, a light 19 may be provided for illuminating the trajectory of the hit ball 11. Also, these cameras 14 and 15 may be equipped with respective strobes 20 (flashing means) which operate synchronously with shutters thereof. Each of the horizontal distances between the hit ball 11 on its trajectory and the first and second cameras 14 and 15 is preferably 200 to 600 mm.

The control unit 16, which is connected to the sensor means 13, the cameras 14 and 15 equipped with the respective strobes 20, the monitor 17, and the printer 18 (specific connections are not illustrated), includes the following:

(1) Control box

The control box includes the following:

a) Frame memory for recording photographed images b) Image analysis unit c) Timing control unit Sensor control, shutter control, I/O d) CPU unit e) FDD (floppy disk drive), HDD (hard disk drive), or flash memory (2) Software Software for performing the following functions:

a) Calculation and display of head speed, initial velocity, launch angle (upward angle with respect to a horizontal line and sideward angle with respect to a reference line), backspin, and side spin b) Calculation of trajectory and travel distance c) Display of the following screens Divided screen (2 display areas for displaying the image of a ball and 1 display area for displaying measured values)

Launch angle distribution screen

Carry and/or total distance distribution screen

Trajectory screen d) Accumulation of data

Figure 2:
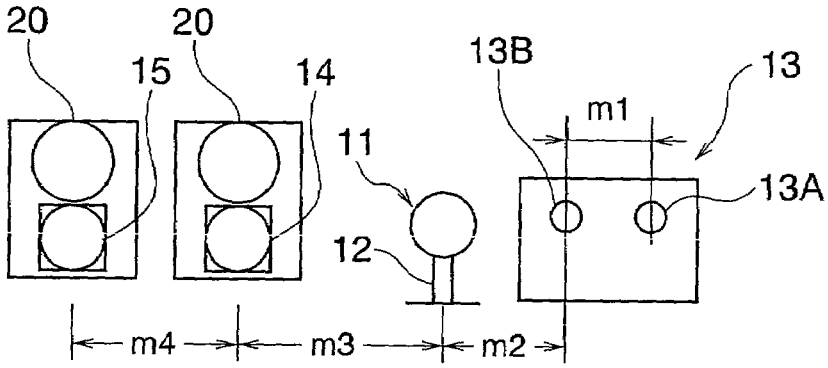
FIG. 2 is a view showing the arrangement of devices of the system of FIG. 1.
Figure 3:
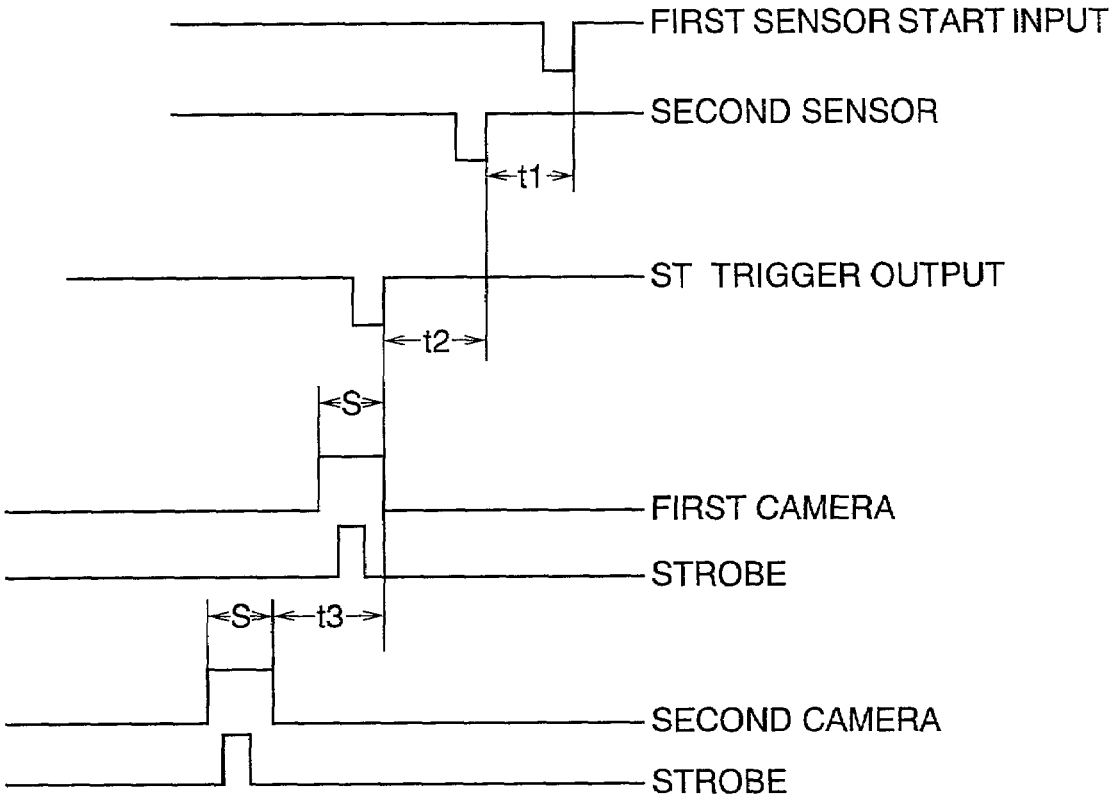
FIG. 3 is a timing chart illustrating operation of the system of FIG. 1.

Next, a method which the present system employs in order to measure head speed, initial velocity, launch angle (upward angle with respect to a horizontal line), backspin, and side spin and to calculate travel distance will be described with reference to FIGS. 2 and 3. When the first and second sensors 13A and 13B detect the passage of a golf club head, the control unit 16 calculates time t1 required for a club head to pass between the sensors. Based on the measured time t1 and the distance between the sensors 13A and 13B, the control unit 16 calculates a head speed. Upon reception of a detection signal from the second sensor 13B, the control unit 16 outputs a trigger signal to each of the cameras 14 and 15 and to each of the strobes 20. In the present embodiment, a plurality of head speeds are previously measured. In operation, a delay time t2 and a shutter interval t3 are previously set in accordance with an applicable head speed selected from the previously measured head speeds. Further, an initial velocity is measured from a time which the hit ball required to pass through the region between the two cameras 14 and 15 and the distance between the two cameras 14 and 15.

Figure 4:
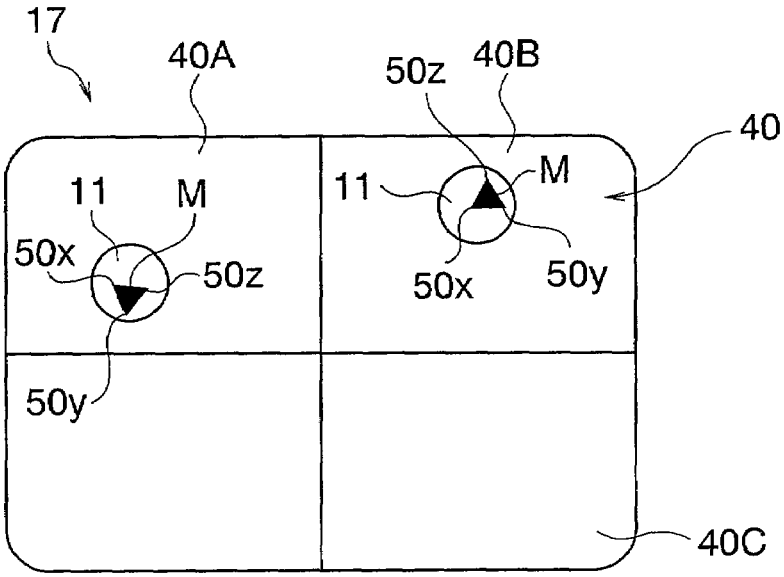
FIG. 4 is a view showing a monitor screen of the system of FIG. 1.

FIG. 4 shows the screen of the monitor 17 on which images of the hit ball are displayed. The monitor screen 40 is divided into four display areas. A first display area 40A displays the side view of the hit ball 11 as obtained through the first camera 14. A second display area 40B displays the side view of the hit ball 11 as obtained through the second camera 15. A third display area 40C displays measured values. In the present system, the mark M formed on the surface of the golf ball 11 assumes the form of an isosceles triangle. The mark M is colored black or similar dark color such that the mark M stands out against the color of the ball surface.

In the present system, with respect to images appearing in the first and second display areas 40A and 40B (FIG. 4), outlines of the golf ball 11 displayed as a white portion are extracted from the black background by means of a binarizing method for digitizing the images into binary data (black/white). Subsequently, the mark M within each of the outlines of the golf ball 11 is extracted by means of a similar binarizing method.

After completion of the above-described processing, a main axis (a height-direction straight line bisecting the vertex angle) of the mark M is obtained; and the mark M is perpendicularly scanned from the main axis in order to obtain a change point at which the color changes from black to white. This scanning operation for searching a color-change point is performed along the main axis. As a result, lines respectively passing through two rows of change points; i.e., two sides, are obtained. Subsequently, base lines which perpendicularly intersect the median lines of the sides are set outside the black block (black mark); and scanning is performed from the base lines toward the block side in order to obtain the base. When the sides and the base are obtained, curve approximation is preferably employed in consideration of curvature of the spherical surface.

After a triangle; i.e., the mark M, is specified through the above-described image processing, three angular points 50*x*, 50*y*, and 50*z* are determined from the sides and the base. Subsequently, the three-dimensional vectors of the three angular points 50*x*, 50*y*, and 50*z* are obtained on the basis of the images appearing in the first and second display areas 40A and 40B, with the ball 11 being taken as a unit ball having a radius of 1. Based on the movement of the ball 11 from its position in the first display area 40A to that in the second display area 40B, the vector of the rotational axis of the ball 11 is obtained. Through a vector operation between the rotational axis vector and the position vectors of the respective points, the amount of rotation of the ball 11 is obtained. Based on the rotational axis vector and the rotation amount, the amounts of backspin and side spin of the ball 11 can be obtained. Also, a difference in vertical position of the golf ball 11 between the first display area 40A and the second display area 40B (FIG. 4) is measured. Then, based on the thus-measured difference in vertical position and the distance m4 (horizontal distance), the upward launch angle of the ball 11 can be obtained. Further, a travel distance can be calculated from the thus-obtained initial velocity, launch angle, backspin, and side spin.

In the present system, launch angle, backspin, and side spin are obtained by use of the mark M of an isosceles triangle formed on the surface of the golf ball 11. However, launch angle, backspin, and side spin may be obtained in a similar manner by use of a character or a mark of another shape provided on the surface of a golf ball.

Next, an example method of selecting a golf club by use of the present system will be described. In the system, the sensor means 13, the first camera 14, the second camera 15, the control unit 16, and the monitor 17 constitute actual hit data obtainment means; the control unit 16 and the monitor 17 constitute ideal data obtainment means; the control unit 16 constitutes comment producing means; and the control unit 16 and the printer 18 constitute printing means.

(1) First, a golfer hits a golf ball with a golf club which the golfer has used up to now and which is therefore familiar to the golfer. At this time, the actual hit data obtainment means obtains the head speed, initial velocity, launch angle, backspin, side spin, and travel distance of the hit ball in the above-described manner. These values are displayed on the monitor 17. Each of these values may be an average value or a maximum value obtained through hitting of a plurality of balls.

(2) Subsequently, the ideal data obtainment means obtains an ideal initial velocity, launch angle, backspin, side spin, and travel distance of the golfer on the basis of the head speed obtained by the actual hit data obtainment means. Specifically, the calculation unit 16 calculates the ideal initial velocity, launch angle, and backspin from the head speed in accordance with the following expressions. The ideal side spin is set zero. The ideal travel distance is calculated from the ideal initial velocity, launch angle, backspin, and side spin in accordance with a predetermined expression. These values are displayed on the monitor 17.

Ideal initial velocity = F × head speed + G
F: predetermined coefficient
(e.g., a predetermined value between 1.3 and 1.5)
G: predetermined constant
(e.g., a predetermined value between −0.5 and 0.5)
Ideal launch angle = H × head speed + I
H: predetermined coefficient
(e.g., a predetermined value between −0.3 and −0.2)
I: predetermined constant
(e.g., a predetermined value between 25 and 31)
Ideal backspin = J × head speed + K
J: predetermined coefficient
(e.g., a predetermined value between −50 and −30)
K: predetermined constant
(e.g., a predetermined value between 3700 and 5100)

(3) A golf club suitable for the golfer is selected on the basis of the ideal hit-ball data obtained by the ideal data obtainment means. In this case, one or more clubs which are suitable for realization of the ideal hit-ball data may be selected on the basis of human judgment.

(4) In a manner similar to that used in (1) above, the actual hit data obtainment means obtains the head speed, initial velocity, launch angle, backspin, side spin, and travel distance when the golfer hits a golf ball with the selected golf club. When two or more golf clubs are selected, the above-described values are obtained for each golf club. These values are displayed on the monitor 17. Each of these values may be an average value or a maximum value obtained through hitting of a plurality of balls.

(5) Subsequently, the comment producing means produces a comment on the golf club that the golfer used first. The comment is produced on the basis of the head speed, backspin, and side spin obtained in (1) above. Further, a comment on the golf club that the golfer has selected is produced on the basis of the backspin, side spin, and travel distance obtained in (4) above. Specifically, a sentence is prepared for a certain range of each value as described below and stored in the control unit 16. When a value falls within the corresponding range, the corresponding sentence is selected. These sentences for the respective values are connected automatically so as to produce a comment.

The head speed obtained in (1) falls within a predetermined range: "HEAD SPEED IS SLIGHTLY EXCESSIVE, AND SR, S FLEX, OR SIMILAR TYPE IS PROPER."

The backspin obtained in (1) is slightly greater than ideal backspin: "BACKSPIN IS SLIGHTLY EXCESSIVE."

The side spin obtained in (1) is close to ideal side spin: "TRAJECTORY IS SUBSTANTIALLY STRAIGHT."

These sentences are connected so as to obtain a comment "HEAD SPEED IS SLIGHTLY EXCESSIVE, AND SR, S FLEX, OR SIMILAR TYPE IS SUITABLE. BACKSPIN IS SLIGHTLY EXCESSIVE, BUT TRAJECTORY IS SUBSTANTIALLY STRAIGHT" as a comment on the golf club that the golfer used first.

The backspin obtained in (4) has decreased from the backspin obtained in (1) by a predetermined amount and approaches ideal backspin: "BACKSPIN DECREASES TO A LEVEL CLOSER TO THE PROPER LEVEL."

The side spin obtained in (4) is substantially equal to the backspin obtained in (1) and is close to the ideal side spin: No comment.

The travel distance obtained in (4) has increased considerably as compared to that obtained in (1): "TRAVEL DISTANCE HAS BEEN EXTENDED GREATLY."

These sentences are connected so as to obtain a comment "BACKSPIN DECREASES TO A LEVEL CLOSER TO THE PROPER LEVEL. SIDE SPIN HAS NOT CHANGED, BUT TRAVEL DISTANCE HAS BEEN EXTENDED GREATLY." as a comment on the golf club that the golfer has selected.

Figure 5:
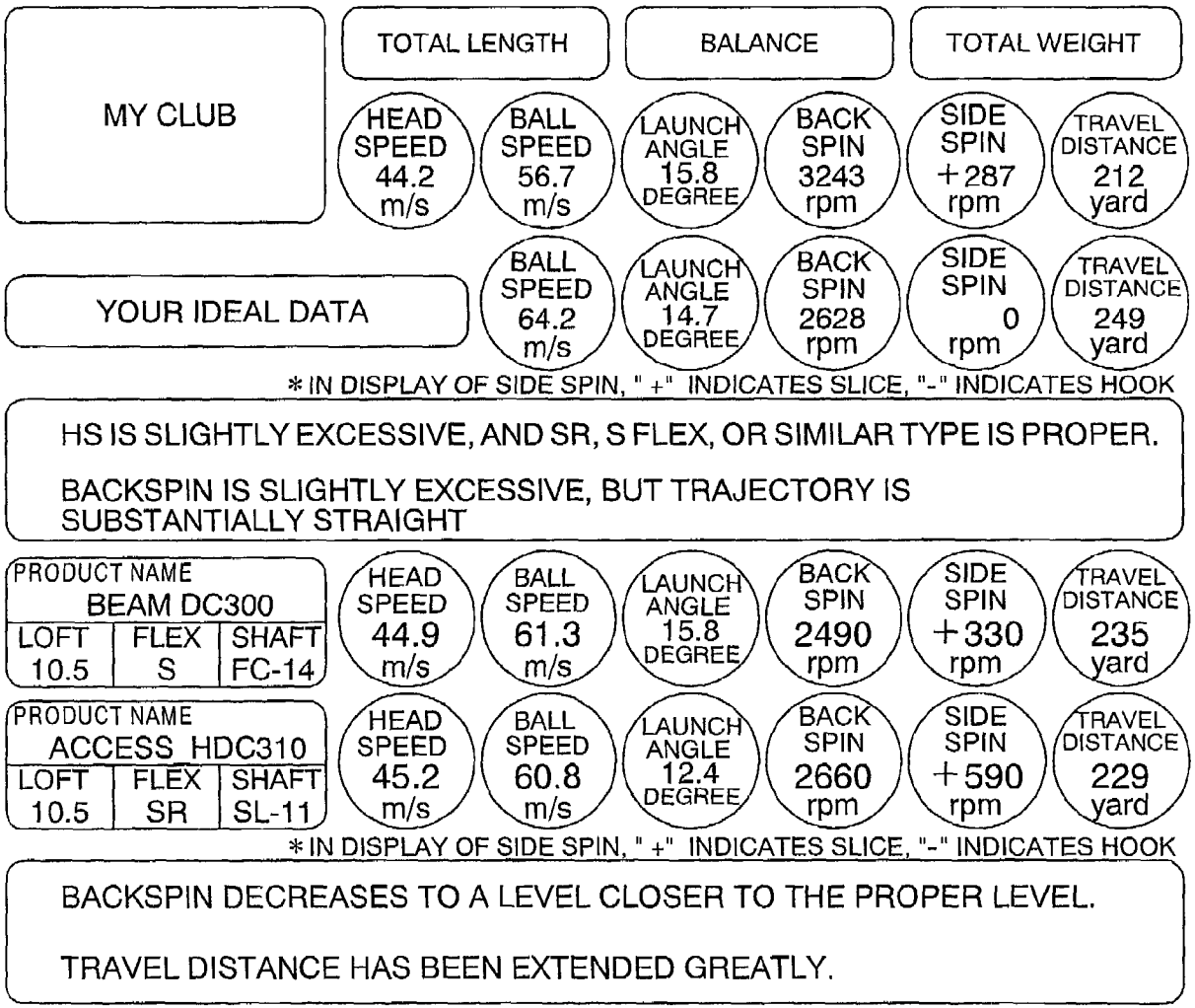
FIG. 5 is a diagram of an example sheet produced by the printing means of the system of FIG. 1.

(6) The printer 18 prints, on a predetermined sheet, the head speed, initial velocity, launch angle, backspin, side spin, and travel distance obtained in (1) above; the ideal initial velocity, launch angle, backspin, side spin, and travel distance obtained in (2) above; and the head speed, initial velocity, launch angle, backspin, side spin, and travel distance of the selected golf club obtained in (4) above. FIG. 5 shows an example sheet produced by the printing means. In FIG. 5, the term "MY CLUB" means the golf club with which the golfer hit golf balls in (1) above; and the term "BALL SPEED" means initial velocity.

What is claimed is:

1. A method for selecting a golf club suitable for a golfer, comprising the steps of:

(a) obtaining at least one of head speed and hit-ball data when a golfer hits a golf ball with a golf club;

(b) automatically calculating ideal hit-ball data of the golfer on the basis of the at least one of head speed and hit-ball data obtained in step (a); and (c) selecting a golf club suitable for the golfer on the basis of the ideal hit-ball data obtained in step (b), wherein:

in the step (a), at least the head speed is obtained, and the ideal hit-ball data includes ideal initial velocity, ideal launch angle and ideal backspin, which are calculated in accordance with the following expressions:

the ideal initial velocity=F×head speed+G;

the ideal launch angle=H×head speed+I; and the ideal back spin=J×head speed+K, wherein F is a coefficient in a range of 1.3 to 1.5, G is a constant in a range of −0.5 to 0.5, H is a coefficient in a range of −0.3 to −0.2, I is a constant in a range of 25 to 31, J is a coefficient in a range of −50 to −30 and K is a constant in a range of 3700 to 5100.

2. The method of claim 1, comprising:

(d) obtaining head speed and hit-ball data when the golfer hits a golf ball with the golf club selected in step (c).

3. The method of claim 1, wherein the golf club used in step (a) has been previously used by the golfer for playing golf.

4. A method for selecting a golf club according to claim 1, wherein the actual hit-ball data include at least one selected from initial velocity, launch angle, backspin, side spin, and travel distance of a hit ball.

5. The method of claim 1, wherein the actual hit-ball data include an initial velocity, a launch angle, a backspin, a side spin, and travel distance of the hit golf ball.

6. The method of claim 1, wherein the selection of the golf club suitable for the golfer is performed automatically.

7. The method of claim 1, wherein the ideal hit-ball data include the travel distance of the hit golf ball.

8. The method of claim 6, wherein the golf club suitable for the golfer is selected based on a golf club specification that includes at least one of total length, balance, total weight, loft angle, face angle and lie angle.

9. A system for selecting a golf club suitable for a golfer, comprising:

an actual hit data obtainment circuit that obtains at least one of head speed and hit-ball data when a golfer hits a golf ball with a golf club; and an ideal data calculation circuit that calculates ideal hit-ball data of the golfer on the basis of the at least one of head speed and hit-ball data obtained by the actual hit data obtainment circuit, wherein a golf club suitable for the golfer is selected on the basis of the ideal hit-ball data obtained by the ideal data obtainment circuit, and wherein:

the actual hit data obtainment circuit obtains at least the head speed, and the ideal data calculation circuit calculates the ideal hit-ball data including ideal initial velocity, ideal launch angle and ideal backspin in accordance with the following expressions:

the ideal initial velocity=F×head speed+G;

the ideal launch angle=H×head speed+I; and the ideal back spin=J×head speed+K, wherein F is a coefficient in a range of 1.3 to 1.5, G is a constant in a range of −0.5 to 0.5, H is a coefficient in a range of −0.3 to −0.2, I is a constant in a range of 25 to 31, J is a coefficient in a range of −50 to −30 and K is a constant in a range of 3700 to 5100.

10. A system for selecting a golf club according to claim 9, wherein head speed and hit-ball data at the time when the golfer hits a golf ball with the selected golf club are obtained by the actual hit data obtainment circuit.

11. A system for selecting a golf club according to claim 9, further comprising:

a comment producing circuit that produces a comment for the golfer on the basis of the at least one of the head speed and hit-ball data obtained by the actual hit data obtainment circuit.

12. The system of claim 9, wherein the actual hit-ball data include an initial velocity, a launch angle, a backspin, a side spin, and travel distance of the hit golf ball.

13. The system of claim 9, comprising:

a golf club selection circuit that selects the golf club suitable for the golfer.

14. The system of claim 9, wherein the ideal hit-ball data include the travel distance of the hit golf ball.

15. A system for selecting a golf club according to claim 11, further comprising:

a printing circuit that prints at least one selected from the head speed and hit-ball data obtained by the actual hit data obtainment circuit, ideal hit-ball data calculated by the ideal data calculation circuit, and the comment produced by the comment producing circuit.

16. The system of claim 13, wherein the golf club suitable for the golfer is selected based on a golf club specification that includes at least one of total length, balance, total weight, loft angle, face angle and lie angle.

* * * * *